United States Patent [19]

Hodge

[11] 4,137,519

[45] Jan. 30, 1979

[54] RESISTOR MATERIAL, RESISTOR MADE THEREFROM AND METHOD OF MAKING THE SAME

[75] Inventor: Malcolm H. Hodge, Philadelphia, Pa.

[73] Assignee: TRW, Inc., Cleveland, Ohio

[21] Appl. No.: 844,793

[22] Filed: Oct. 25, 1977

[51] Int. Cl.[2] ..... H01C 1/012

[52] U.S. Cl. ..... 338/308; 29/610 R; 252/516; 427/101; 427/102

[58] Field of Search ..... 338/307–309; 29/610; 252/516, 515; 427/101, 102; 428/402

[56] References Cited

U.S. PATENT DOCUMENTS

| | | | |
|---|---|---|---|
| 3,180,841 | 4/1965 | Murphy et al. | 252/515 |
| 3,407,032 | 10/1968 | Ziering | 23/23 |
| 3,529,350 | 9/1970 | Rairden | 29/626 |
| 3,537,174 | 11/1970 | May | 29/577 |
| 3,669,724 | 6/1972 | Brand | 427/102 X |
| 4,015,230 | 3/1977 | Nitta et al. | 338/308 X |
| 4,053,866 | 10/1977 | Merz et al. | 338/309 |

FOREIGN PATENT DOCUMENTS 1326769 10/1970 United Kingdom.

OTHER PUBLICATIONS

B. L. Crowder, et al., *Journal of Chemical Physics*, "Some Solid-State Studies of Tungsten Trioxide and Their Significance to Tungstten Bronze Theory" vol. 38, No. 7, pp. 1576–1583, Nov. '62.

K. M. Merz, et al., *Electronic Components Conference* "Tungsten Carbicle-Tungsten Resistive Glazes", pp. 1–7, 1966.

R. Fuchs, *Journal of Chemical Physics*, "Electronic Properties of the Tungsen Bronzes", vol. 42, No. 11, Jun. 1966, pp. 3781–3789.

H. Braekken, *Journal of Applied Physics*, "Two Higher Phase Transitions of $WO_3$", pp. 3635–3636, 1966.

A. B. Knox, *Trans. British Ceramic Society*, "Properties of $WO_3$ Modified by the Substitution of Mo and Cr", pp. 85–91, 1966.

H. Hirohata, et al., *Japan Soc. of Powder and Powder Metallurgy*, "Electrical Resistance of $NiO_1Fe_2O_3$ and $WO_3$ During Hydrogen Reduction", pp. 86–89, 1969.

N Kaneki, et al., *Journal of the American Ceramic Society*, "Effect of Atmosphere on Resistivity of $WO_3$ Ceramics", vol. 59, No. 7, pp. 368–369, 1976.

D. Auda, et al., *Ceramic Bulletin*, "Ceramic Glazes for Thick Film Microelectronics", vol. 47, No. 6, pp. 565–568, 1968.

F. E. Buzan, et al., *Circuits Manufacturing*, "Base Metal Thick Film System-Resistors Conductors and Dielectrics", pp. 34–39, Oct. 1977.

*Primary Examiner*—C. L. Albritton

*Attorney, Agent, or Firm*—Jacob Trachtman

[57] ABSTRACT

A vitreous enamel resistor material which includes a mixture of fine particles of tungsten carbide, tungsten trioxide and a glass frit. The resistor material may also include fine particles of tungsten. The resistor material is made into a resistor by coating the mixture on a substrate, firing the coating at a temperature at which the glass frit melts, and then cooling the coated substrate to form the resistor having a layer of glass with the particles dispersed therein.

20 Claims, 1 Drawing Figure

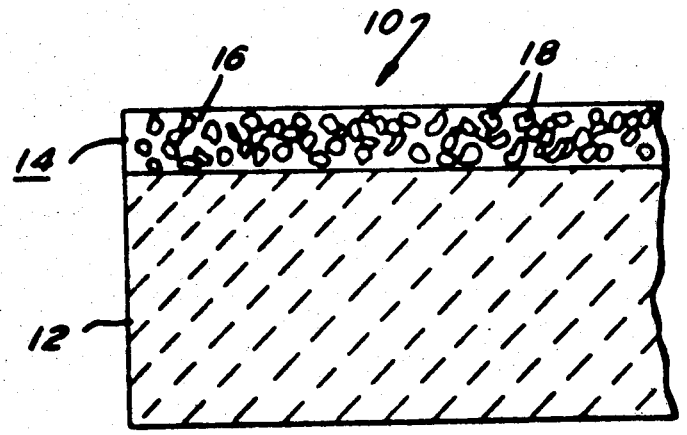
10
16
18
14
12

RESISTOR MATERIAL, RESISTOR MADE THEREFROM AND METHOD OF MAKING THE SAME

The present invention relates to a resistor material, resistors made from the material, and a method of making the same. More particularly, the present invention relates to a vitreous enamel resistor material which provides resistors having a wide range of resistance values, and low temperature coefficients of resistance, and which are made from relatively inexpensive materials.

A type of electrical resistor material which has come into commercial use is a vitreous enamel resistor maerial which comprises a mixture of a glass frit and finely divided particles of an electrical conductive material. The vitreous enamel resistor material is coated on the surface of a substrate of an electrical insulating material, usually a ceramic, and fired to melt the glass frit. When cooled, there is provided a film of glass having the conductive particles dispersed therein.

Since there are requirements for electrical resistors which have a wide range of resistance values, it is desirable to have vitreous enamel resistor materials with properties which allow the making of resistors having resistance values over a wide range. However, it is also desirable that such resistance materials provide a low temperature coefficient of resistance, so that the resistors are relatively stable with respect to changes in temperature. Heretofore, the resistor materials which provided these characteristics, generally utilized the noble metals as the conductive particles and are, therefore, relatively expensive.

It is, therefore, an object of the present invention to provide a novel resistor material and resistor made therefrom.

It is another object of the present invention to provide a novel vitreous enamel resistor material and a resistor made therefrom.

It is a still further object of the present invention to provide a vitreous enamel resistor material which provides resistors having a wide range of resistivities, and relatively low temperature coefficients of resistance.

It is another object of the present invention to provide a vitreous enamel resistor material which provides resistors having a wide range of resistivitites, and relatively low temperature coefficients of resistance, and which are made of relatively inexpensive materials.

It is still another object of the present invention to provide a vitreous enamel resistor material which is a mixture of a glass frit, and fine particles of tungsten carbide and tungsten trioxide.

Other objects will appear hereinafter.

The invention accordingly comprises a composition of matter possessing the characteristics, properties, and the relation of components which are exemplified in the compositions hereinafter described, and the scope of the invention is indicated in the claims.

For a fuller understanding of the nature and objects of the invention, reference should be had to the following detailed description taken in connection with the accompanying drawing in which:

The FIGURE is a sectional view of a portion of an electrical resistor made with the resistor material of the present invention.

In general, the vitreous enamel resistor material of the present invention comprises a mixture of a vitreous glass frit and fine particles of tungsten carbide and tungsten trioxide. The tungsten compounds are present in the mixture in the amount of by weight of 35% to 75% tungsten carbide, and 2% to 20% tungsten trioxide. For reasons which will be explained later, particles of tungsten metal of up to 50% by weight of the amount of tungsten carbide in the mixture, may be included in the resistor material.

The glass frit used may be any of the well known compositions used for making vitreous enamel resistor compositions and which has a melting point below that of the tungsteon compounds. However, it has been found preferable to use a borosilicate frit, and particularly an alkaline earth borosilicate frit, such as a barium or calcium borosilicate frit. The preparation of such frits is well known and consists, for example, of melting together the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The resistor material of the present invention is preferably made by mixing together the glass frit, tungsten carbide, tungsten trioxide, and tungsten (if used) in the proper proportions. This is achieved by ball milling the mixture in a liquid, such as water or butyl carbitol acetate. The mixture is ball milled for a period of between ½ hour and 24 hours, but typically for one hour. The mixture is then heated at 150° C until the liquid is evaporated off and the mixture is dry. The mixture is then mixed with a suitable vehicle for the manner in which it is to be applied to a substrate for making a resistor. For painting, spraying or dipping, the liquid such as butyl carbitol acetate may be used as the vehicle, whereas for screen printing, the vehicle may be a Reusche screening medium.

To make a resistor with the resistor material of the present invention, the resistor material is applied to a uniform thickness on the surface of a substrate. The substrate may be a body of any material which can withstand the firing temperature of the resistor material. The substrate is generally a body of an electrically insulating or a ceramic material, such as glass, porcelain, steatite, barium titanate, alumina, or the like. The resistor material may be applied on the substrate by brushing, dipping, spraying or screen stencil application. The substrate with the resistor material coating is then fired in a conventional furnace at a temperature at which the glass frit becomes molten. The resistor material is preferably fired in an inert or non-oxidizing atmosphere, such as argon, helium or nitrogen. The particular firing temperature used depends on the melting temperature of the glass frit used. When the substrate and resistor material are cooled, the vitreous enamel hardens to bond the resistance material to the substrate.

As shown in the FIGURE of the drawing, a resultant resistor of the present invention is generally designated as 10. The resistor 10 comproses a ceramic substrate 12 having a layer 14 of the resistor material of the present invention coated and fired thereon. The resistor material layer 14 comprises the glass 16 containing the finely divided particles 18 of the tungsten compounds and tungsten (if used). The particles are embedded in and dispersed throughout the glass 16.

The following examples are given to illustrate certain preferred details of the invention, it being understood that the details of the examples are not to be taken as in any way limiting the invention thereto.

EXAMPLE I

A resistor material was made by mixing together in butyl carbitol acetate a mixture of by weight 15% tungsten, 60% tungsten carbide, 20% tungsten trioxide and 5% glass frit. The glass frit was of the composition of by weight 48.5% barium oxide, 7.5% calcium oxide, 23.3% boron oxide and 20.7% silicon dioxide. The mixture was then heated at 150° C to evaporate the butyl carbitol acetate and dry the mixture. The dry mixture was then blended with a Reusche screening medium. Resistors were made with the material by screen printing the material on the surface of alumina substrates. The coated substrates were dried and then fired over a half hour cycle in a conveyor furnace at a peak temperature of 975° C in a nitrogen atmosphere. The resistance of the resultant resistors were measured and the resistors were tested for their temperature coefficients of resistance. The resistors had the following average electrical characteristics:

| | |
|---|---|
| Resistance (ohms/square) | 2.9 |
| Temperature Coeff. of Resistance (PPM/° C) | |
| −82° C | 158 |
| +150° C | 184 |

EXAMPLE II

A resistor material was made in the same manner as described in EXAMPLE I, except that it contained by weight 4% tungsten, 36% tungsten carbide, 12% tungsten trioxide and 48% glass frit. Resistors were made from the resistor material described in EXAMPLE I, except that the coated substrates were fired at 1000° C. The resultant resistors had the following average electrical characteristics:

| | |
|---|---|
| Resistance (ohms/square) | 12K |
| Temperature Coeff. of Resistance (PPM/° C) | |
| −82° C | −42 |
| +150° C | −6 |

EXAMPLE III

A plurality of batches of resistor materials were made in the manner described in EXAMPLE I, with each batch containing by weight 50% glass frit, 10% tungsten trioxide, and 40% tungsten carbide plus tungsten. However, the ratio of tungsten carbide to tungsten varied in each batch, fron no tungsten to one half tungsten and one half tungsten carbide. Resistors were made from each batch of the resistor material in the manner described in EXAMPLE I, and the resultant resistors had the average electrical characteristics shown in the following table:

| Ratio of Tungsten Carbide to Tungsten | 100:0 | 10:1 | 4:1 | 2:1 | 1:1 |
|---|---|---|---|---|---|
| Resistance (ohms/square) | 6.9K | 1.02K | 1.64K | 1.64K | 841 |
| Temperature Coeff. of Resistance (PPM/° C) | | | | | |
| −82° C | −458 | −126 | −217 | −160 | ∓43 |
| +150° C | −418 | −30 | −102 | −63 | 42 |

EXAMPLE IV

A plurality of batches of resistor materials were made in the manner described in EXAMPLE I, with each batch containing by weight 5% glass frit, 20% tungsten trioxide and 75% tungsten carbide plus tungsten with the ratio of tungsten carbide to tungsten varying in the manner described in EXAMPLE III. Resistors were made from each batch of resistor material in the manner described in EXAMPLE I, and the resultant resistors had the average electrical characteristics shown in the following table:

| Ratio of Tungsten Carbide to Tungsten | 100:0 | 10:1 | 4:1 | 2:1 | 1:1 |
|---|---|---|---|---|---|
| Resistance (ohms/square) | 4.1 | 8.3 | 6.9 | 5.9 | 4.5 |
| Temperature Coeff. of Resistance (PPM/° C) | | | | | |
| −82° C | 91 | −256 | −231 | −131 | 44 |
| +150° C | 0 | −205 | −187 | −185 | −72 |

EXAMPLE V

A resistor material was made in the manner described in EXAMPLE I, except that the material contained by weight 40% tungsten carbide, 10% tungsten trioxide, and 50% glass frit. Resistors were made from the resistor material in the manner described in EXAMPLE I, except that the coated substrates were fired at 1000° C. The resultant resistors had the following average electrical characteristics:

| | |
|---|---|
| Resistance (ohms/square) | 1.3K |
| Temperature Coeff. of Resistance (PPM/° C) | |
| −82° C | 142 |
| +150° C | 179 |

EXAMPLE VI

A resistor material was made in the same manner as described in EXAMPLE V, and resistors were made from the resistor material in the same manner except that the coated substrates were fired at 1025° C. The resultant resistors had the following average electrical characteristics:

| | |
|---|---|
| Resistance (ohms/square) | 1.03K |
| Temperature Coeff. of Resistance (PPM/° C) | |
| −82° C | 232 |
| +150° C | 177 |

EXAMPLE VII

A resistor material was made in the manner described in EXAMPLE I, except that it contained by weight 35% tungsten carbide, 2% tungsten trioxide and 63% glass frit. The resistor material was made into resistors in the manner described in EXAMPLE I, except that the coated substrates were fired at 1000° C. The resultant resistors had the following average electrical characteristics:

| | |
|---|---|
| Resistance (ohms/square) | 446 |
| Temperature Coeff. of Resistance (PPM/° C) | |
| −82° C | 156 |
| +150° C | 176 |

EXAMPLE VIII

A resistor material was made in the same manner as described in EXAMPLE I, except that it contained 35% tungsten carbide, 4% tungsten trioxide and 61% glass frit. The resistor material was made into resistors in the manner described in EXAMPLE I, and the resultant resistors had the following average electrical characteristics:

| | |
|---|---|
| Resistance (ohms/square) | 640 |
| Temperature Coeff. of Resistance (PPM/° C) | |
| −82° C | 175 |
| +150° C | 124 |

EXAMPLE IX

A resistor material was made in the manner described in EXAMPLE I, except that it contained by weight 35% tungsten carbide, 6% tungsten trioxide and 59% glass frit. Resistors were made from the resistor material in the manner described in EXAMPLE I, and the resultant resistors had the following average electrical characteristics:

| | |
|---|---|
| Resistance (ohms/square) | 724 |
| Temperature Coeff. of Resistance (PPM/° C) | |
| −82° C | ±150 |
| +150° C | ∓71 |

EXAMPLE X

A resistor material was made in the manner described in EXAMPLE I, except that it contained by weight 35% tungsten carbide, 9% tungsten trioxide and 56% glass frit. Resistors were made from the resistor material in the manner described in EXAMPLE I, except that the coated substrates were fired at 1000° C. The resultant resistors had the following electrical characteristics:

| | |
|---|---|
| Resistance (ohms/square) | 285 |
| Temperature Coeff. of Resistance (PPM/° C) | |
| −82° C | ∓55 |
| +150° C | ∓38 |

EXAMPLE XI

A plurality of batches of resistor materials were made by mixing together in butyl carbitol acetate a mixture of by weight 75% tungsten carbide, tungsten trioxide in the amount shown in the following table, and the balance of the glass frit described in EXAMPLE I. After mixing, each batch was heated at 150° C until dry and then blended with a Reusche screening medium. Resistors were made with each batch by coating the resistor material on the surface of an alumina substrate by screen printing. The coated substrates were dried and then fired in nitrogen at 975° C. The following table shows the average resistance and temperature coefficient of resistance for the resistors made from each batch.

| | | | | |
|---|---|---|---|---|
| Tungsten Trioxide (weight %) | 14 | 16 | 18 | 20 |
| Resistance (ohms/square) | 18.7 | 9.2 | 5.1 | 4.1 |
| Temperature Coeff. of Resistance (PPM/° C) | | | | |
| −82° C | 56 | 69 | 124 | 91 |
| +150° C | 104 | 61 | 34 | 0 |

From the above Examples it can be seen that the resistor material of the present invention can provide resistors having a wide range of resistance values and relatively low temperature coefficients of resistance. From EXAMPLES I and II it can be seen that resistance values as low as 2.9 ohms/square and as high as 12K ohms/square with temperature coefficients of resistance of less than 200 parts per million/° C can be provided by the resistor material of the present invention. EXAMPLES III and IV show the effects of adding tungsten to the resistor material, and EXAMPLES I, V and VI show the effects of varying the firing temperature. EXAMPLES VII through XI show the effects of varying the amount of the tungsten trioxide.

During the firing of the coated substrates, the tungsten trioxide is reduced to tungsten dioxide. Since the firing of the resistors is done in an inert or non-oxidizing atmosphere, the reducing of the tungsten trioxide provides a controlled amount of oxygen for oxidizing the tungsten carbide and any tungsten in the resistor material. This permits a control of the temperature coefficient of resistance, so that relatively low temperature coefficients of resistance can be achieved over the wide range of resistance values. This effect is not achieved by initially providing tungsten dioxide in the resistor material, even though the fired resistor layer may finally have the same amount of tungsten dioxide as is achieved with the use of tungsten trioxide in the resistor material.

It will thus be seen that the objects set forth above, and others made apparent from the preceding description, are efficiently attained and, since certain changes may be made in the above compositions of matter without departing from the scope of the invention, it is intended that all matter contained in the above description shall be interpreted as illustrative and not in a limiting sense.

What is claimed is:

1. A resistor material comprising a mixture of particles of tungsten carbide, tungsten trioxide, and a glass frit.

2. A resistor material in accordance with claim 1 in which the mixture also contains particles of tungsten.

3. A resistor material in accordance with claim 1 in which the ingredients are present in the mixture in the amount of by weight 35% to 75% tungsten carbide, 2% to 20% tungsten trioxide, tungsten in the amount of 0 to 50% of the amount of tungsten carbide and the remaining being the glass frit.

4. A resistor material in accordance with claim 3 in which the glass frit is a borosilicate glass.

5. A resistor material in accordance with claim 4 in which the glass frit is an alkaline earth borosilicate glass.

6. An electrical resistor comprising an electrically insulating substrate and a resistor material on a surface of said substrate, said resistor material comprising a glass layer having embedded therein and dispersed therethroughout a mixture of particles of tungsten carbide and tungsten dioxide reduced from tungsten trioxide.

7. An electrical resistor in accordance with claim 6 in which the resistor material also includes particles of tungsten in the glass layer.

8. An electrical resistor in accordance with claim 7 in which the resistor material includes by weight 35% to 75% tungsten carbide, tungsten dioxide reduced from 2% to 20% tungsten trioxide, and tungsten in the amount of 0 to 50% of the tungsten carbide.

9. An electrical resistor in accordance with claim 8 in which the glass is a borosilicate glass.

10. An electrical resistor in accordance with claim 9 in which the glass is an alkaline earth borosilicate glass.

11. A method of making an electrical resistor comprising the steps of mixing together particles of tungsten carbide, tungsten trioxide and a glass frit, coating the mixture onto the surface of a substrate of an electrically insulating material, firing said coated substrate in a non-oxidizing atmosphere at a temperature at which the glass frit becomes molten, and then cooling said coated substrate.

12. The method of claim 11 in which the non-oxidizing atmosphere in which the coated substrate is fired is nitrogen.

13. The method of making an electrical resistor in accordance with claim 11 including mixing particles of tungsten with the particles of tungsten carbide, tungsten trioxide and the glass frit.

14. The method of making an electrical resistor in accordance with claim 13 in which the proportion of the ingredients in the mixture are by weight 35% to 75% tungsten carbide, 2% to 20% tungsten trioxide, tungsten in the amount of 0 to 50% of the amount of tungsten carbide, and the remaining being the glass frit.

15. The method of making an electrical resistor in accordance with claim 14 in which the ingredients are mixed together in a liquid vehicle, the resulting mixture is heated to remove the liquid vehicle and dry the mixture, and the dry mixture is then blended with a vehicle suitable for applying the mixture to the substrate, and the non-oxidizing atmosphere in which the coated substrate is fired is nitrogen.

16. An electrical resistor of the vitreous enamel type made by mixing together particles of tungsten carbide, tungsten trioxide and a glass frit, coating the mixture onto the surface of a substrate of an electrically insulating material, firing said coated substrate in a non-oxidizing atmosphere at a temperature at which the glass frit becomes molten, and then cooling said coated substrate.

17. An electrical resistor of the vitreous enamel type made in accordance with claim 16 in which the non-oxidizing atmosphere in which the coated substrate is fired is nitrogen.

18. An electrical resistor of the vitreous enamel type made in accordance with claim 16 which includes mixing particles of tungsten with the particles of tungsten carbide, tungsten trioxide and the glass frit, and the non-oxidizing atmosphere in which the coated substrate is fired is nitrogen.

19. An electrical resistor of the vitreous enamel type made in accordance with claim 18 in which the proportion of the ingredients in the mixture are by weight 35% to 75% tungsten carbide, 2% to 20% tungsten trioxide, tungsten in the amount of 0 to 50% of the amount of tungsten carbide, and the remaining being the glass frit.

20. An electrical resistor of the vitreous enamel type made in accordance with claim 19 in which the ingredients are mixed together in a liquid vehicle, the resulting mixture is heated to remove the liquid vehicle and dry the mixture, and the dry mixture is then blended with a vehicle suitable for applying the mixture to the substrate, and the non-oxidizing atmosphere in which the coated substrate is fired is nitrogen.

* * * * *